US005263462A

United States Patent [19]

Reddy

[11] Patent Number: 5,263,462

[45] Date of Patent: Nov. 23, 1993

[54] SYSTEM AND METHOD FOR DETECTING LEAKS IN A VAPOR HANDLING SYSTEM

[75] Inventor: Sam R. Reddy, Bloomfield, Mich.

[73] Assignee: General Motors Corporation, Detroit, Mich.

[21] Appl. No.: 968,132

[22] Filed: Oct. 29, 1992

[51] Int. Cl.[5] ..... F02M 33/02; F02B 77/00

[52] U.S. Cl. ..... 123/520; 123/198 D

[58] Field of Search ..... 123/198 D, 516, 518, 123/520, 519

[56] References Cited

U.S. PATENT DOCUMENTS

| | | | |
|---|---|---|---|
| 4,819,607 | 4/1989 | Aubel | 123/519 |
| 4,926,825 | 5/1990 | Ohtaka et al. | 123/520 |
| 4,949,695 | 8/1990 | Uranishi et al. | 123/520 |
| 4,962,744 | 10/1990 | Uranishi et al. | 123/520 |
| 5,021,071 | 6/1991 | Reddy | 123/518 |
| 5,088,466 | 2/1992 | Tada | 123/520 |
| 5,113,834 | 5/1992 | Aramaki | 123/520 |
| 5,143,035 | 1/1992 | Kayanuma | 123/198 D |
| 5,146,902 | 9/1992 | Cook et al. | 123/518 |
| 5,150,689 | 9/1992 | Yano et al. | 123/519 |
| 5,158,054 | 10/1992 | Otsuka | 123/198 D |
| 5,191,870 | 3/1993 | Cook | 123/198 D |

FOREIGN PATENT DOCUMENTS

91/12426 8/1991 World Int. Prop. O. .

OTHER PUBLICATIONS

Siemens documents-OBDII Systems and Components (16 pages) Aug. 28, 1992.

Siemens documents-Proposal for Pressure Testing the Evaporative System (OBDII) (18 pages) May 11, 1992.

*Primary Examiner*—E. Rollins Cross

*Assistant Examiner*—Thomas Moulis

*Attorney, Agent, or Firm*—Charles K. Veenstra

[57] ABSTRACT

This invention relates to a diagnostic system that detects a leak in an engine vapor handling system by checking whether a predetermined pressure or vacuum is attained in a fuel tank when a corresponding temperature change occurs in the fuel tank while the engine was not running.

9 Claims, 3 Drawing Sheets

SYSTEM AND METHOD FOR DETECTING LEAKS IN A VAPOR HANDLING SYSTEM

TECHNICAL FIELD

This invention relates to a diagnostic system detecting leaks in a vapor handling system.

SUMMARY OF THE INVENTION

In a conventional vapor handling system for an engine, fuel vapor that escapes from a fuel tank is stored in a canister. If there is a leak in the fuel tank, canister or any other component of the vapor handling system, some fuel vapor could exit through the leak to escape into the atmosphere instead of being stored in the canister.

Leaks in the vapor handling system can contribute to vehicle emissions. Therefore, it is desirable to have a diagnostic system to alert the operator when a leak exists. The present invention provides a system for detecting a leak as small as 0.02 inches 0.51 mm) diameter in the vapor handling system.

One embodiment comprises temperature and pressure sensors. While the vehicle is soaking (engine off), the temperature sensor will monitor the temperature in the fuel tank. If the temperature increases by a preselected temperature increment, a switch (temperature) will set. The pressure sensor monitors the pressure of the fuel tank and vent lines, and will set a switch (pressure) if a preselected pressure is attained during soak. The pressure switch will set at a preselected value which is lower than a threshold pressure of a pressure control valve which allows vapor to vent from the fuel tank to the canister.

At engine start up, a computer control module will check whether the fuel tank experienced an adequate heat build up during its soak, i.e. if the temperature switch was set while the engine was off. If the preselected temperature increase was not attained, the switch is not set and no diagnostic leak check will be done.

If the temperature switch is set, then the computer control module will check if the pressure switch is set. If the pressure switch is set, there is no leak in the system since the vapor handling system was able to hold or maintain a certain level of pressure. If the pressure switch is not set then the vapor handling system could not attain the preselected pressure value because the vapors were emitting into the atmosphere through a leak. The first embodiment of the diagnostic system accordingly indicates a leak when the temperature switch is set during a soak, but the pressure switch is not set.

A second embodiment of the invention comprises a means to measure a decrease of temperature in the fuel tank while the engine is soaking, and a means to measure the fuel tank vacuum. To measure whether there is a decrease of temperature in the fuel tank while the engine is soaking, a timer and an engine temperature sensor are used. A timer in the computer control module tabulates the elapsed time the engine is running and stores that information for later retrieval. If the elapsed time is greater than a preselected time, this indicates that the fuel tank was sufficiently hot before the soak. The engine temperature sensor, usually one that measures the engine coolant temperature, is monitored at engine start up. If the engine temperature is less than a preselected temperature, this indicates that the fuel tank is cool. Therefore, if the elapsed time is greater than the preselected time and the engine temperature is less than the preselected temperature, this indicates that the fuel tank temperature decreased so that a vacuum should have been created in the fuel tank.

The vacuum sensor monitors the vacuum of the fuel tank and vent lines, and will set a switch (vacuum) if a preselected vacuum is attained during the soak. If the vacuum switch is not set while the fuel tank temperature decreased, this indicates a leak in the vapor handling system. The second embodiment of the diagnostic system accordingly indicates a leak if the vacuum switch is not set while the elapsed time is greater than a preselected time and the engine temperature is less than a preselected temperature.

Alternatively, the decrease of temperature in the fuel tank could be determined by a temperature sensor that monitors temperature in the fuel tank, similar to that in the first embodiment. The second embodiment has the advantage of not requiring a separate temperature sensor and switch. Instead it uses an engine coolant sensor and a timer in the computer control module that currently exist on most computer controlled engines. The details as well as other features and advantages of this invention are set forth in the remainder of the specification and are shown in the drawings.

DESCRIPTION OF THE PREFERRED EMBODIMENTS

Figure 1:
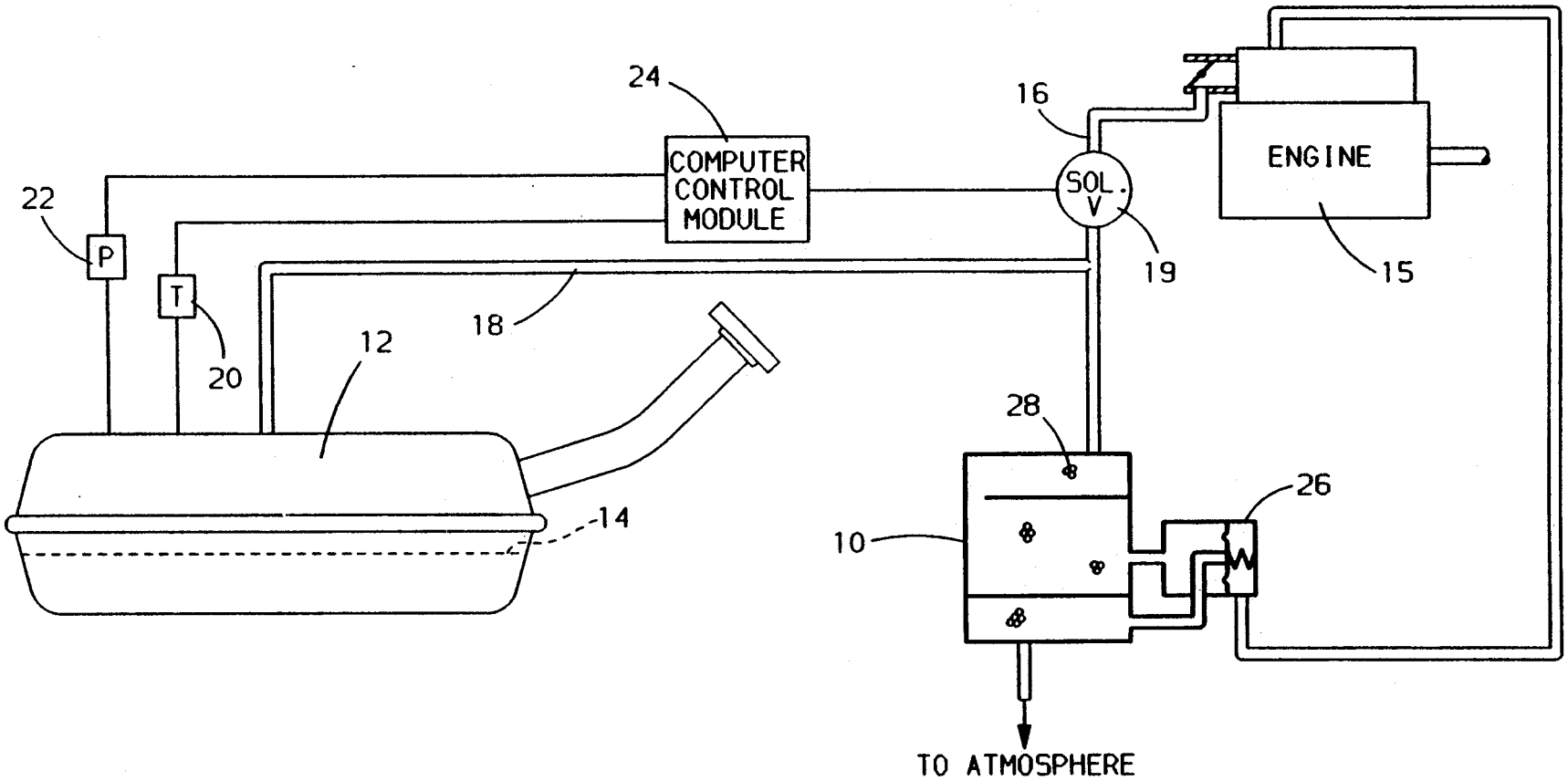
FIG. 1 is a schematic view of a system for detecting leaks according to a first embodiment of the invention.

FIG. 1 shows a vapor handling system connected to an engine. A canister 10, and a fuel tank 12 containing a quantity of fuel 14 are connected to the air induction system of the vehicle engine 15 by conduits 16 and 18. A purge solenoid valve 19, is closed when the engine 15 is not running, and is operated by the computer control module 24 to control flow through conduit 16 to the intake of the engine 15 when the engine is running. A fuel tank temperature switch 20 and a pressure switch 22 monitor the vapor handling system and provide input to a computer control module 24 for a diagnostic system.

Generally during normal driving conditions, the engine 15 and fuel tank 12 temperatures will increase. At initial engine shut down and a period of time beyond that, the fuel tank 12 will cool. But if the vapor handling system is subject to ambient conditions warmer than the fuel tank 12 temperature, the fuel tank 12 temperature will increase. The first embodiment of the invention provides a diagnostic test to determine whether there is a leak when this condition occurs.

As the fuel 14 temperature increases, evaporation of the fuel 14 occurs to form a mixture of air and fuel vapors. The air-fuel vapor mixture will increase the pressure in the vapor handling system. In a system having a canister 10 similar to that described in U.S. Pat.

No. 5,148,793 issued Sep. 22, 1992 in the name of S. Raghuma Reddy, when the pressure of the air-fuel vapor mixture formed in tank 12 exceeds a threshold pressure of a pressure control valve 26, the mixture is vented to canister 10 through conduit 18, where the fuel vapor component is stored in the activated charcoal granules 28. If there is a leak in the vapor handling system, the threshold pressure of the pressure control valve 26 will never be attained. The vapors will exit the vapor handling system through the leak and enter into the atmosphere, rather than being stored in the canister 10.

The invention determines whether there is a leak in the vapor handling system by monitoring the fuel tank 12 temperature increase and vapor handling system pressure while the engine 15 is not running (soaking).

The temperature switch 20 may be a type having an electrical circuit capable of storing an initial temperature when the engine is stopped and continually comparing it to the current temperature over a period of time. If the fuel tank 12 temperature increases by a preselected value, the temperature switch 20 is set.

If the system pressure exceeds a preselected pressure while the engine is not running, the pressure switch 22 is set. The pressure switch 22 may be a mechanical OPEN-CLOSE device that responds to a preselected pressure. It may be located anywhere within the vapor handling system. The preselected pressure which sets the pressure switch 22 will be less than the threshold pressure of the pressure control valve 26. This allows the diagnostic test to occur at a smaller pressure increase than is required to open the pressure control valve 26, which permits air-fuel mixture to vent to the canister 10.

The diagnostic test occurs during the initial start-up routine of the engine. The computer control module 24 checks the status of the temperature switch 20. If the computer control module 24 finds the temperature switch 20 set, the computer control module 24 will further check whether the pressure switch 22 is set. When both the temperature and pressure switches 20 and 22 respectively are set, it indicates that the vapor handling system does not have a leak. If the pressure switch 22 is not set while the temperature switch 20 is set, it indicates that there is a leak in the system. If the temperature switch 20 is not set, it indicates that the conditions during the engine soak were not satisfactory to diagnose the vapor handling system, and the computer control module 24 will not continue with the diagnosis. Therefore a diagnostic leak check will not necessarily occur at every engine start-up.

Figure 2:
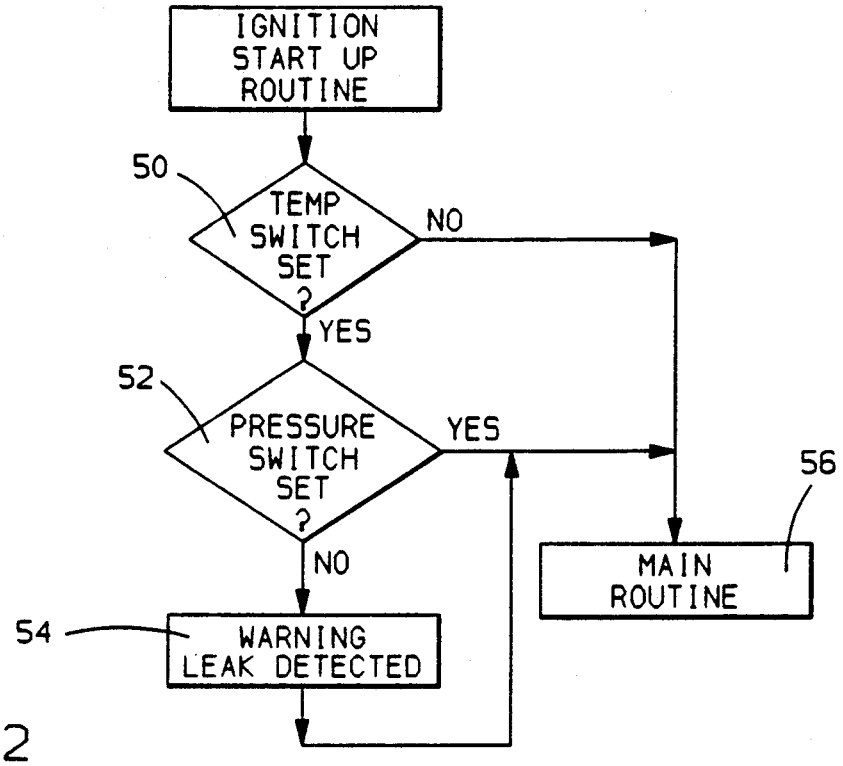
FIG. 2 is a flow chart of the routine carried out by a computer control module according to the first embodiment of the invention.

FIG. 2 is a flow chart of the first embodiment diagnostic test. This routine is only done at ignition start up, and repeated each time the engine 15 is started.

As shown in FIG. 2, at step 50, it is determined whether or not the predetermined soaking condition occurred to continue the diagnostic leak test by checking the tank temperature switch 20. If the temperature switch 20 was set, the process continues to step 52, at which point the pressure switch 22 is checked.

If the pressure switch 22 is not set at this point, there is a leak in the vapor handling system. The process goes to step 54 and the computer control module 24 delivers a warning signal or code to the driver that indicates that a leak is detected. The computer will then proceed to a main routine 56 not detailed here. If the result is NO at step 50 or YES at step 52, the computer will also proceed to the main routine 56. The main routine 56 will include resetting the temperature and pressure switches.

Figure 4:
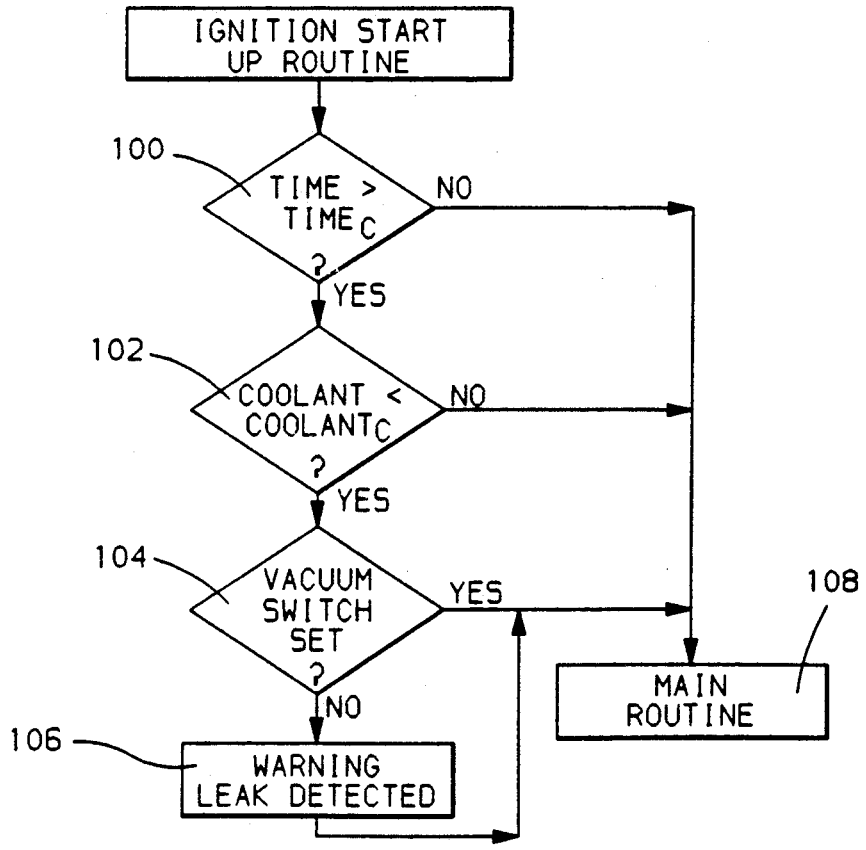
FIG. 4 is a flow chart of the routine carried out by a computer control module according to the second embodiment of the invention.
Figure 3:
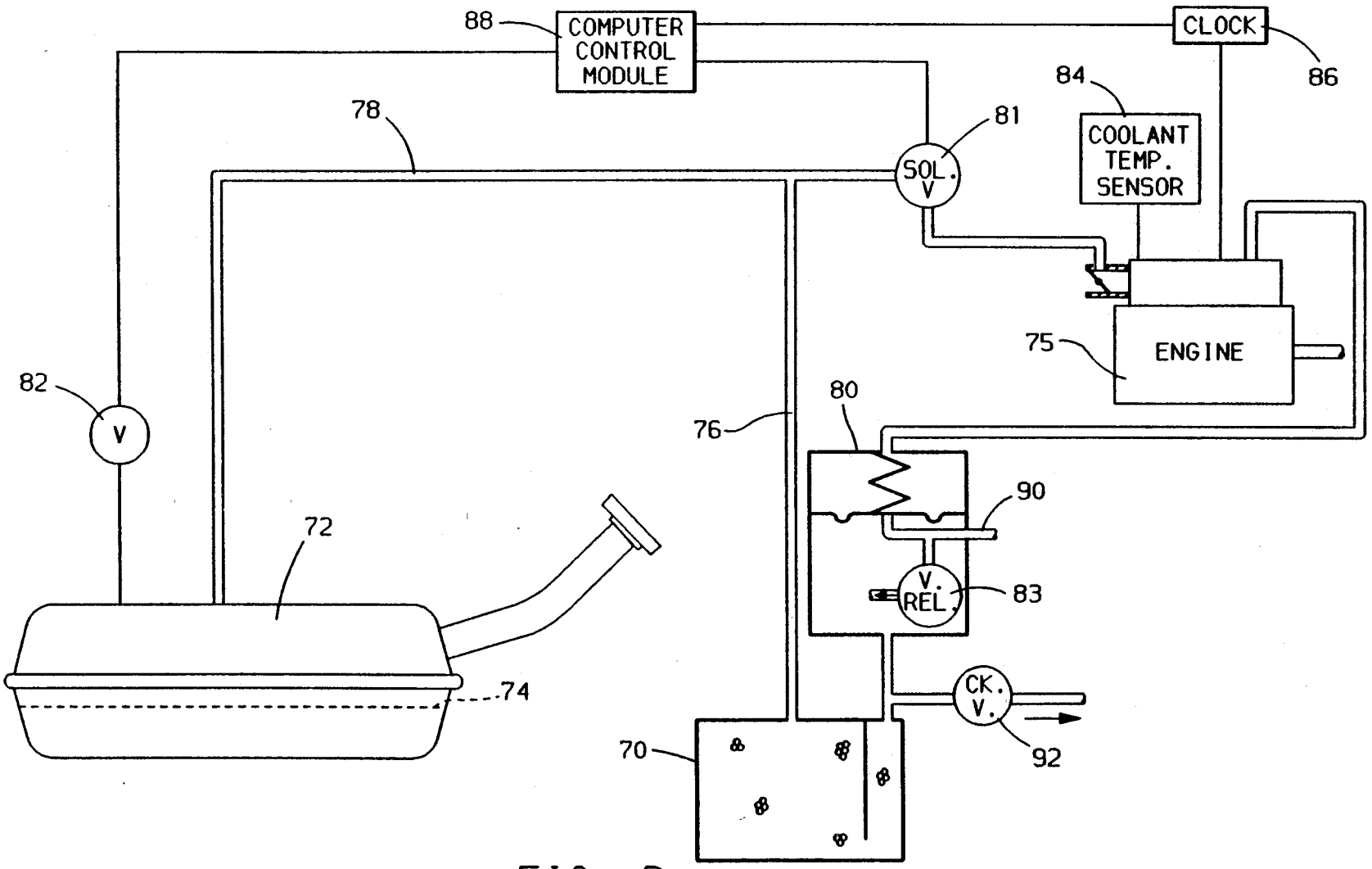
FIG. 3 is a schematic view of a system for detecting leaks according to a second embodiment of the invention.

FIGS. 3 and 4 show a second embodiment of the present invention. FIG. 3 shows a vapor handling system. A canister 70 is connected to the air induction system of the vehicle engine 75 by conduits 76 and 78. A fuel tank 72, containing a quantity of fuel 74 is connected to the air induction system of the vehicle engine 75 by conduit 78, and to the canister 70 by conduits 76 and 78. A pressure control valve 80 may be a separate unit as shown in FIG. 3; or the pressure control valve 80 may be incorporated in the canister 70 construction. A purge solenoid valve 81, is closed when the engine 75 is not running, and is operated by the computer control module 88 to control flow through conduit 78 when the engine is running. A vacuum switch 82, an engine coolant sensor 84, and a clock 86 monitor the system and provide input to the computer control module 88 for the diagnostic test.

This alternative embodiment determines whether a vacuum in the vapor handling system attained a preselected level during engine cool down while the engine 75 was soaking. When the engine 75 is initially turned off after running for a period of time, the fuel tank 72 temperature is generally higher than ambient temperature. As the tank cools, vacuum should be created in the tank 72. This second embodiment of the invention provides a diagnostic test, to determine whether there is a leak when this condition occurs.

While the engine 75 is on, the clock 86 monitors the time that the engine 75 is running and stores that information in the computer control module 88 for later retrieval, when the engine is restarted.

If the engine 75 had been running for a sufficient period of time, the fuel tank 72 temperature will be warmer than the ambient temperature when the engine 75 is initially turned off. Therefore, the fuel tank 72 will begin to cool. As the fuel tank 72 cools, vacuum is created in the fuel tank 72. The vacuum can be monitored by the vacuum switch 82 and is similar in type to the pressure switch 22 in FIG. 1. When the vacuum attains a preselected level the vacuum switch 82 will be set. If the vacuum does not attain the preselected level, this indicates a leak in the vapor handling system. The vacuum switch 82 may be located anywhere within the vapor handling system.

A vacuum relief valve 83 is located in the air vent 90 to the pressure control valve 80. This will allow atmospheric air to enter the canister 70 via the pressure control valve 80 when a vacuum is created in the vapor handling system. The vacuum switch 82 will set at a vacuum value equal to or less than the vacuum required to open the vacuum relief valve 83.

FIG. 4 more clearly describes the steps of the second embodiment of the diagnostic test. The diagnostic test occurs at engine start up. In step 100 the clock 86 is checked to determine whether the engine 75 had been running previously for more than a preselected time.

This is to ensure that the engine 75 was sufficiently warmed up before being turned off, and that the fuel tank 72 temperature would be higher than most ambient temperatures. If the clock 86 is greater than a predetermined value, the process goes to step 102.

In step 102 the engine coolant temperature 84 is monitored to determine whether the coolant temperature is less than a preselected value. Both the previous clock 86 time and the current engine coolant 84 temperature must meet their predetermined values to continue with the diagnostic test. If both of these conditions are met, the process continues to step 104. The vacuum switch 82, is checked whether it was set while the engine 75 was soaking. If the vacuum switch 82 is not set at this point, there is a leak in the vapor handling system, the process goes to step 106 and the computer control module 88 delivers a warning signal or code to the driver that indicates that there is a leak detected. Otherwise the process proceeds to a main routine 108 not detailed here. Once the warning signal is delivered to the driver, the process also continues to the main routine 108 where the vacuum switch is reset.

Another variation of the second embodiment is to eliminate the vacuum switch 82 and replace it with an air flow sensor (not shown) at the entrance of the air vent 90 of the canister 70. Such an air flow sensor reads the amount of atmospheric air entering the canister 70 while the vapor handling system is in a vacuum state during engine soak. This sensor reads in units of volume/time. If the air flow sensor does not read at least a predetermined value, there is a leak in the vapor handling system. The use of such an air flow sensor will require the computer control module 88 to monitor this sensor while the engine is off.

A check valve 92 may also be added in the air vent 90 area of the canister 70. It provides a pressure relief valve to vent vapors to atmosphere when no pressure above atmospheric pressure is desired in the fuel tank 72.

In summary, the first embodiment will provide a diagnostic test if the temperature of the fuel tank increases while the engine is soaking. This type of condition might not occur during soaks in cold climates or during soaks over night.

In contrast, the second embodiment will provide a diagnostic test if the fuel tank temperature decreases while the engine is soaking. This type of condition might not occur during soaks in hot climates. Therefore, to provide a leak check nearly every time the engine is started, it would be appropriate to incorporate both embodiments for the diagnostic test.

The foregoing descriptions of the two embodiments for purpose of describing the invention are not to be considered as limiting or restricting the invention since many modifications may be made by the exercise of skill in the art without departing from the scope of this invention.

The embodiments of the invention in which an exclusive property or privilege is claimed are defined as follows:

1. A diagnostic system for detecting a leak in a vapor handling system for an engine and having a fuel tank, said diagnostic system comprising:

a means for detecting a temperature change in the fuel tank while the engine is not running, a means for detecting a pressure change in the fuel tank while the engine is not running, and a means for determining whether or not a leak exists in the vapor handling system by comparing said temperature change with said pressure change.

2. A diagnostic system for detecting a leak in a vapor handling control system for an engine and having a fuel tank, said diagnostic system comprising:

a means for detecting a predetermined increase of temperature in the fuel tank while the engine is not running, a means for detecting a predetermined pressure level of the fuel tank while the engine is not running, and a means to indicate a leak in the vapor handling system if the predetermined pressure level is not attained while the predetermined temperature increase is attained.

3. A diagnostic system for detecting a leak in a vapor handling system for an engine and having a fuel tank, said diagnostic system comprising:

a means for detecting a decrease of temperature in the fuel tank, while the engine is not running, a means for detecting a predetermined vacuum level in the vapor handling system while the engine is not running, and a means for indicating a leak in the vapor handling system if the predetermined vacuum level is not attained while a predetermined temperature decrease is attained.

4. A diagnostic system for detecting a leak in a vapor handling system according to claim 3, wherein said means for detecting a predetermined decrease of temperature in the fuel tank comprises:

a device that measures the elapsed time the engine was on before shut off, and a temperature sensor that measures an engine temperature, wherein a predetermined decrease of temperature is indicated when the elapsed time the engine is on is greater than a selected time and the engine temperature is less than a preselected temperature.

5. A method of detecting a leak in a vapor handling system for an engine and having a fuel tank, comprising the steps of:

measuring a temperature change in said fuel tank while the engine is not running, measuring a pressure change in said fuel tank while the engine is not running, and determining whether or not a leak exists in the engine vapor handling system by comparing said temperature change with said pressure change.

6. A method of detecting a leak in a vapor handling system for an engine and having a fuel tank, comprising the steps of:

measuring a temperature increase in said fuel tank while the engine is not running, measuring a pressure in said fuel tank while the engine is not running, and indicating a leak if said pressure is less than a selected pressure while said temperature increase exceeds a selected increment.

7. A method of detecting a leak in a vapor handling system for an engine and having a fuel tank, comprising the steps of:

detecting a temperature decrease in said fuel tank while the engine is not running, measuring a vacuum level in said fuel tank while the engine is not running, and indicating a leak if a predetermined vacuum level is not attained while said temperature decrease exceeds a selected decrement.

8. A method of detecting a leak in the system as recited in claim 7, wherein the step of detecting a temperature decrease in said fuel tank, comprises the steps of:

measuring the elapsed time that the engine is on, saving the elapsed time when the engine is turned off, measuring a temperature of the engine, and comparing the elapsed time with the engine temperature.

9. A diagnostic system for detecting a leak in a vapor handling system for an engine and having a fuel tank, said diagnostic system comprising:

means for determining whether the pressure in said fuel tank changes in a predetermined manner in response to changes in temperature while the engine is not running.

* * * * *